United States Patent [19]

Nagata et al.

[11] Patent Number: 4,869,225

[45] Date of Patent: Sep. 26, 1989

[54] FUEL SUPPLY DEVICE FOR VEHICLES

[75] Inventors: Kiyoshi Nagata, Kariya; Junichi Tatsukawa, Okazaki; Yutaka Kawashima, Hiroshima; Hisanori Kobayashi, Aichi, all of Japan

[73] Assignee: Nippondenso Co., Ltd., Kariya, Japan

[21] Appl. No.: 261,901

[22] Filed: Oct. 25, 1988

[30] Foreign Application Priority Data

Oct. 26, 1987 [JP] Japan ..... 62-269894
Jul. 20, 1988 [JP] Japan ..... 63-181145

[51] Int. Cl.[4] ..... F02M 29/00

[52] U.S. Cl. ..... 123/509; 123/514; 123/516; 137/592

[58] Field of Search ..... 123/509, 514, 510, 516, 123/495; 137/590, 592, 565, 895

[56] References Cited

U.S. PATENT DOCUMENTS

| | | | |
|---|---|---|---|
| 2,785,546 | 3/1957 | Bauerlein | 137/895 |
| 2,953,156 | 9/1960 | Bryant . | |
| 3,049,171 | 8/1962 | Neuerburg | 137/590 |
| 4,010,768 | 3/1977 | Hechler | 137/585 |
| 4,340,023 | 7/1982 | Greager | 137/590 |
| 4,397,333 | 8/1983 | Liba et al. . | |
| 4,503,885 | 3/1985 | Hall . | |
| 4,672,937 | 6/1987 | Fales | 123/509 |
| 4,694,857 | 9/1987 | Harris | 137/565 |
| 4,706,707 | 11/1987 | Betterton | 137/592 |
| 4,750,522 | 6/1988 | Griffin | 123/514 |
| 4,776,315 | 10/1988 | Greiner | 123/509 |

FOREIGN PATENT DOCUMENTS

| | | | |
|---|---|---|---|
| 2440905 | 3/1976 | Fed. Rep. of Germany . | |
| 2804550 | 8/1979 | Fed. Rep. of Germany . | |
| 0119960 | 7/1983 | Japan | 123/514 |

*Primary Examiner*—Carl S. Miller
*Attorney, Agent, or Firm*—Cushman, Darby & Cushman

[57] ABSTRACT

In a fuel supply device for vehicles, a sub-tank is arranged within a fuel tank. At least one intake port is provided in a bottom wall of the sub-tank. A check valve is arranged at the intake port. A fuel pump is arranged within the sub-tank to supply fuel from the sub-tank to an engine. A fuel return pipe is provided through which a part of the fuel supplied through the fuel supply pipe is returned into the sub-tank. A jet pump is connected to the fuel return pipe so as to deliver the fuel within the fuel tank into the sub-tank through at least one suction port of the jet pump by using fluid energy of the fuel returned into the sub-tank. A pipe is connected to a fuel discharge port of the jet pump, and extends to an upper location within the sub-tank. The jet pump is constituted by a groove forming a flat fluid control device arranged between the fuel pump and the bottom wall of the sub-tank. The groove is formed therein with the fuel suction port and the fuel discharge port of the jet pump.

10 Claims, 7 Drawing Sheets

FUEL SUPPLY DEVICE FOR VEHICLES

The present invention relates to a fuel supply device for vehicles, in which a fuel pump is arranged within a fuel tank installed on a vehicle to supply fuel from the fuel tank to an engine of the vehicle.

A fuel supply device of the kind referred to above is known. In the known fuel supply device, air is drawn into the fuel pump and then the "breathing" phenomena occur, when fuel around a suction port of the fuel pump of in-tank type arranged within the fuel tank runs short because of lowering of the level of the fuel within the fuel tank or because of fluctuation, inclination or the like of the level of the fuel within the fuel tank. This results in inconvenience such as hindrance of smooth fuel supply to the engine.

In order to avoid such inconvenience, a fuel supply device has been proposed, in which a sub-tank is arranged on a bottom surface of a fuel tank. A fuel pump is accommodated in the sub-tank. A fuel intake port is formed in a bottom wall of the sub-tank for bringing the interior and the exterior of the sub-tank into communication with each other so as to introduce the fuel within the fuel tank into the sub-tank. A check value is provided at the fuel intake port to prevent the fuel from flowing back into the fuel tank from the sub-tank.

It is possible for the above fuel supply device to equalize the level of the fuel within the sub-tank to that of the fuel within the fuel tank, because the subtank and the fuel tank communicate with each other through the fuel intake port formed in the bottom wall of the sub-tank. It is difficult for the above fuel supply device, however, to collect the fuel in such a manner that the level of the fuel within the sub-tank is raised to a position higher than the level of the fuel within the fuel tank A fuel supply device has been proposed in U.S. Pat. No. 4,397,333 in which a part of the fuel discharged through a discharge port of the fuel pump is returned to the fuel tank through a fuel return pipe. The fuel return pipe is connected to a jet pump having a fuel discharge port and a fuel suction port. The fuel discharge port and the fuel suction port of the jet pump open to the sub-tank and the fuel tank, respectively. The jet pump utilizes fluid energy of the fuel flowing through the fuel return pipe to draw the fuel within the fuel tank into the sub-tank through the fuel suction port.

In the fuel supply device disclosed in the above U.S. patent, the fuel within the fuel tank can forcibly be drawn into the sub-tank by the jet pump such that the level of the fuel within the sub-tank is raised to a position above the level of the fuel within the fuel tank. This makes it possible to prevent air from being drawn through the suction port of the fuel pump. Moreover, even if the remaining fuel within the fuel tank is reduced in quantity, the fuel can be collected into the sub-tank and can effectively be supplied to the engine without waste.

Furthermore, in the fuel supply device disclosed in the U.S. patent, the discharge port of the jet pump opens to a location above the suction port of the fuel pump. Accordingly, even if the fuel within the sub-tank flows out thereof after stoppage in operation of the engine, the level of the fuel within the sub-tank does not lower to a position lower than the discharge port of the jet pump, but is maintained at a position higher than the suction port of the fuel pump.

In the fuel supply device disclosed in the U.S. patent, however, the sub-tank must be formed into a wide configuration along the flat bottom surface of the fuel tank, and it is difficult to mount such wide sub-tank into the fuel tank. Thus, there has been desired a fuel supply device for vehicles, in which the sub-tank can extend from a ceiling surface of the fuel tank toward the bottom surface thereof, and has such a configuration as to be elongated along the longitudinal axis of the fuel tank.

Moreover, in the fuel supply device having incorporated therein the jet pump disclosed in the U.S. patent, there is such an anxiety that when the fuel pump stops in operation, the fuel within the sub-tank flows from the fuel discharge port back to the fuel tank through the fuel suction port.

OBJECT AND SUMMARY OF THE INVENTION

It is therefore an object of the invention to provide a fuel supply device for vehicles, in which a fuel pump can be so arranged as to extend from a ceiling surface toward a bottom surface of a fuel tank installed on the vehicle, and a sub-tank elongated longitudinally of the fuel pump can be mounted within the fuel tank simultaneously with the fuel pump, and a presently existing space is effectively utilized to enable a jet pump to be integrated with the sub-tank in a compact fashion, and it is possible to prevent the fuel of a high level stored within the sub-tank from flowing from the interior to the exterior of the sub-tank even under stoppage in operation of the fuel pump.

It is another object of the invention to provide a fuel supply device for vehicles, in which a presently existing space is effectively utilized to enable a jet pump to be mounted into a sub-tank, and in which even if a fuel pump stops in operation, fuel within the sub-tank is prevented from flowing from the fuel discharge port of the jet pump back to the fuel tank through the fuel suction port of the jet pump.

A fuel supply device for vehicles, according to the invention, comprises a fuel tank which is installed on a vehicle. The fuel tank has a ceiling surface, a bottom surface and a side surface. The ceiling surface is formed therein with an opening which is closed by a cover. A sub-tank is fixedly mounted to the cover. The sub-tank is arranged within the fuel tank so as to extend toward the bottom surface of the fuel tank. The sub-tank is capable of storing fuel of a level higher than that of fuel within the fuel tank. At least one intake port is provided in a bottom wall of the sub-tank. The fuel within the fuel tank is introduced into the sub-tank through the intake port. A fuel supply pipe extends through the cover and is fixedly mounted to the same. The fuel supply pipe connects an interior of the fuel tank to an engine of the vehicle on the outside of the fuel tank.

Furthermore, in the fuel tank a fuel pump is integrated with and arranged within the sub-tank. The fuel pump has a suction port directed toward the bottom wall of the sub-tank and has a discharge port directed toward the ceiling surface of the fuel tank. The discharge port of the fuel pump is connected to the fuel supply pipe.

A fuel return pipe is provided through which a part of the fuel discharged from the discharge port of the fuel pump is returned into the sub-tank and toward the bottom wall thereof.

A jet pump is the form of a plate is arranged between the bottom of the sub-tank and the bottom of the fuel tank. The jet pump has a fuel discharge port and a fuel suction port the jet pump is connected to the fuel return pipe, and is mounted on the sub-tank. The jet pump utilizes fluid energy of the fuel flowing through the fuel return pipe and through the fuel discharge port of the jet pump, to deliver the fuel within the fuel tank from the exterior of the sub-tank to the interior thereof through the fuel suction port.

The discharge port of the jet pump is arranged above the suction port of the fuel pump, in order to prevent the fuel within the sub-tank from flowing out from the fuel discharge port of the jet pump toward the fuel suction port thereof. Further, a check valve is provided at the intake port formed in the bottom wall of the sub-tank in such a manner that the fuel is permitted to flow from the fuel tank into the sub-tank up to a level equal to that of the fuel within the fuel tank, and the fuel into the sub-tank is prevented from flowing out of the sub-tank into the fuel tank.

In the arrangement described above, the subtank, the fuel pump and the jet pump are integrated together and, in particular, the jet pump is disposed in the form of a plate on the bottom of the sub-tank. Accordingly, it is facilitated to mount a fuel supply unit onto the fuel tank, which is composed of the fuel pump, the sub-tank and the jet pump, into the fuel tank, whereby making it possible to effectively utilize the presently existing space for installation of the jet pump. Further, the jet pump, the sub-tank and the fuel pump can be integrated together into the fuel supply unit prior to mounting of it into the fuel tank, whereby making it possible to mount these three components into the fuel tank by a single assembling operation.

Furthermore, since the jet pump is employed which is superior in fuel delivering performance, a sufficient amount of fuel can be stored within the sub-tank, and then the level of fuel within the sub-tank can be raised to a sufficiently high position. Thus, the fuel can be secured within the sub-tank even if the fuel tank shakes due to vibration of the vehicle, whereby making it possible to ensure that the fuel pump is prevented from drawing air through the suction port.

Moreover, once the fuel has flowed into the sub-tank up to a level equal to that of the fuel within the fuel tank, the check valve prevents the fuel stored within the sub-tank from leaking from the interior of the sub-tank to the exterior thereof during stoppage in operation of the fuel pump. Accordingly, when the fuel pump is again started in operation, it does not draw air through the suction port, whereby making it possible to enhance the start-up characteristic of the vehicle.

As described above, the fuel supply device according to the invention is extremely easy in the mounting operation within the fuel tank. The fuel pump, the jet pump and the sub-tank, which form the fuel supply unit, can be arranged within the fuel tank without the necessity of a large space. That is, these three components can be constituted in an integrated fashion so as to extend from the ceiling surface of the fuel tank to the bottom surface thereof. In particular, since the jet pump is in the form of a plate, the presently existing space can effectively be utilized. Thus, it can be facilitated to install the three components into the fuel tank, and the installing operation can be completed at only one time. Moreover, the fuel can be secured sufficiently within the sub-tank not only during operation of the fuel pump, but also during stoppage in operation thereof. Thus, even if the sub-tank is not so much large in size, there can be provided the fuel supply device for vehicles, which can ensure to prevent the fuel pump from drawing air through the suction port.

DETAILED DESCRIPTION OF PREFERRED EMBODIMENTS

Figure 1:
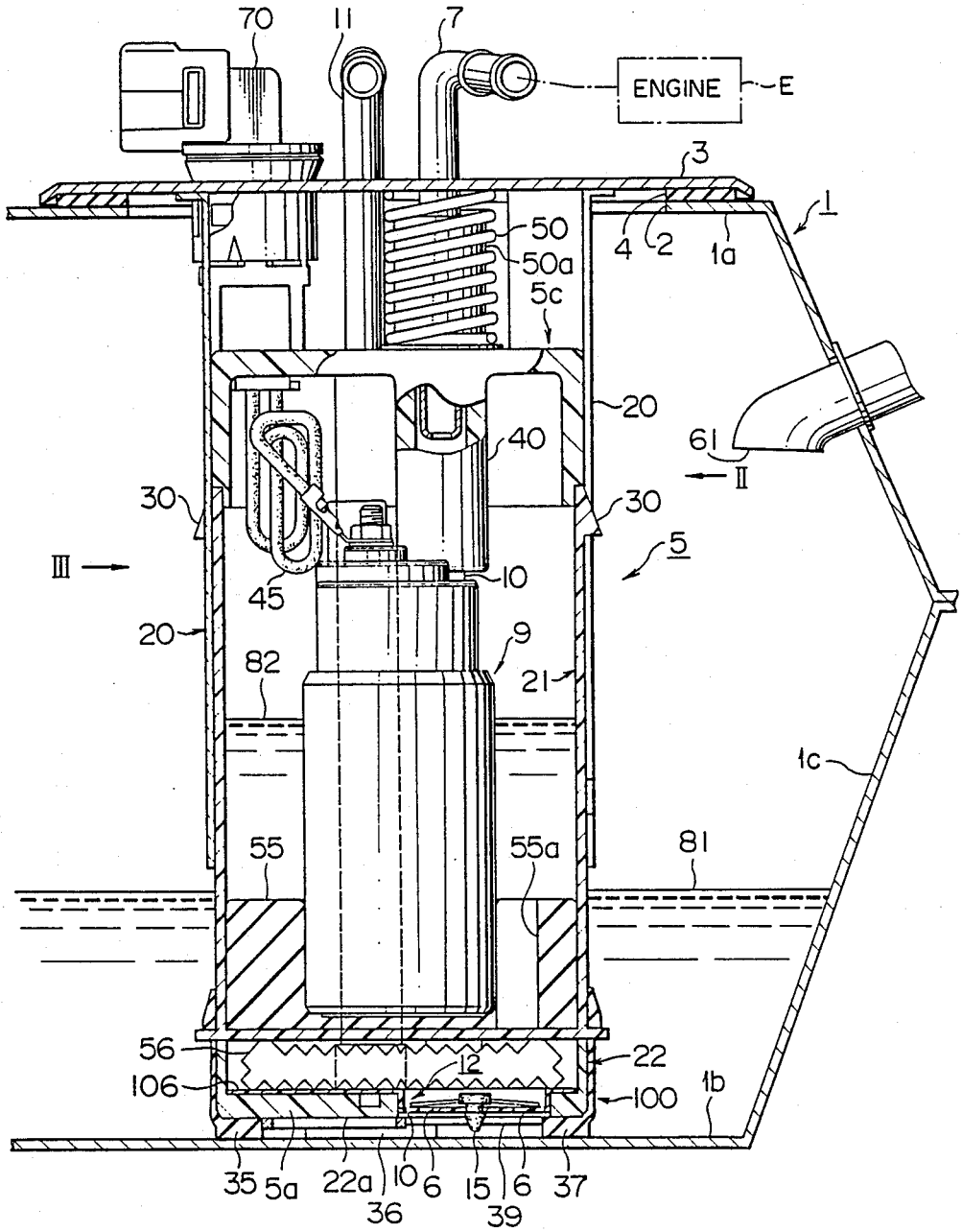
FIG. 1 is a partially cross-sectional front elevational view of a fuel supply device according to an embodiment of the invention.

Referring first to FIGS. 1 through 5, there is shown a fuel supply device for vehicles according to a first embodiment of the invention. The fuel supply device comprises a fuel tank 1 adapted to be installed on a vehicle. The fuel tank 1 is composed of a top wall having a ceiling surface 1*a*, a bottom wall having an inner surface 1*b* and a side wall having an inner surface 1*c*. The top wall of the fuel tank 1 is formed therein with an opening 2. A cover 3 is mounted to the top wall by means of mounting screws or the like, to close the opening 2. A packing seal 4 is interposed between the cover 3 and a part of the top wall of the fuel tank 1 around the opening 2 to provide liquid-tightness between them.

A sub-tank 5 is disposed within the fuel tank 1. The sub-tank 5 is so fixedly mounted to the cover 3 that it extends from the same toward the bottom surface 1*b* of the fuel tank 1. An intake port 6 is associated with a bottom wall 5*a* of the sub-tank 5. Fuel within the fuel tank 1 can be introduced into the sub-tank 5 through the intake port 6. A fuel supply pipe 7 is provided, which extends through the cover 3 and which is fixedly mounted to the same. The fuel supply pipe 7 has one end thereof which is located within the fuel tank 1. The other end of the fuel supply pipe 7 is connected to an engine E of the vehicle.

A fuel pump 9 is located within the sub-tank 5 and has a suction port 8 (see FIG. 2) which is directed toward the bottom surface 5*a* of the sub-tank 5. The fuel pump 9 is so positioned that a discharge port 10 thereof is directed toward the ceiling surface 1*a* of the fuel tank 1. The discharge port 10 is connected to the fuel supply pipe 7 so as to supply the fuel to the engine E through the fuel supply pipe 7.

A part of the fuel discharged through the discharge port 10 of the fuel pump 9 is returned to the sub-tank 5 through a fuel return pipe 11. The fuel return pipe 11 has one end thereof located within the fuel tank 1. The other end of the fuel return pipe 11 may be connected directly to the fuel supply pipe 7 at a location on the outside of the fuel tank 1, or may be connected to a well-known fuel pressure regulator associated with the vehicle engine. Such connecting arrangement of the fuel return pipe 11 is known, and the description of the connecting arrangement will therefore be omitted.

Figure 2:
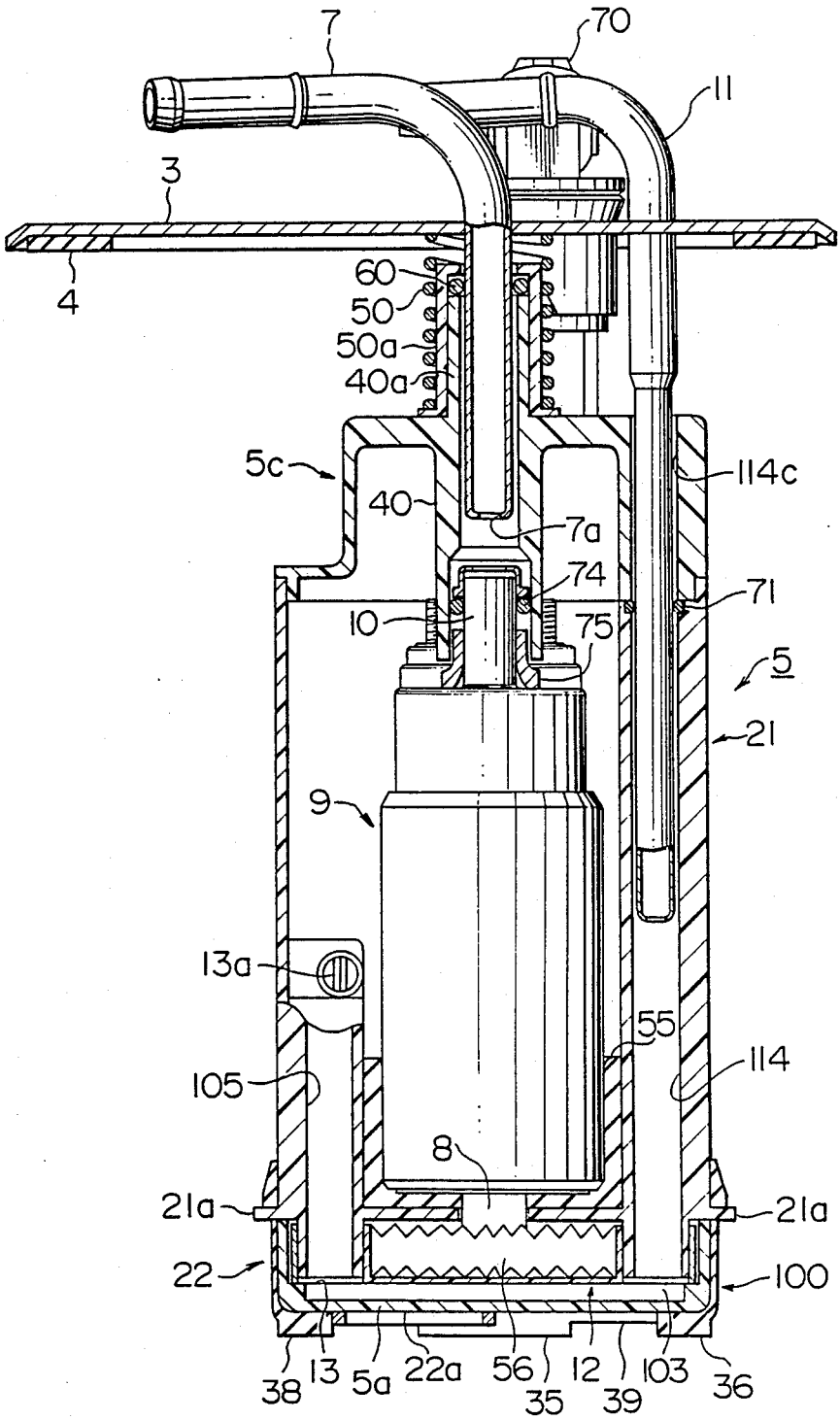
FIG. 2 is a partially cross-sectional side elevational view as viewed from the arrow II in FIG. 1.
Figure 4:
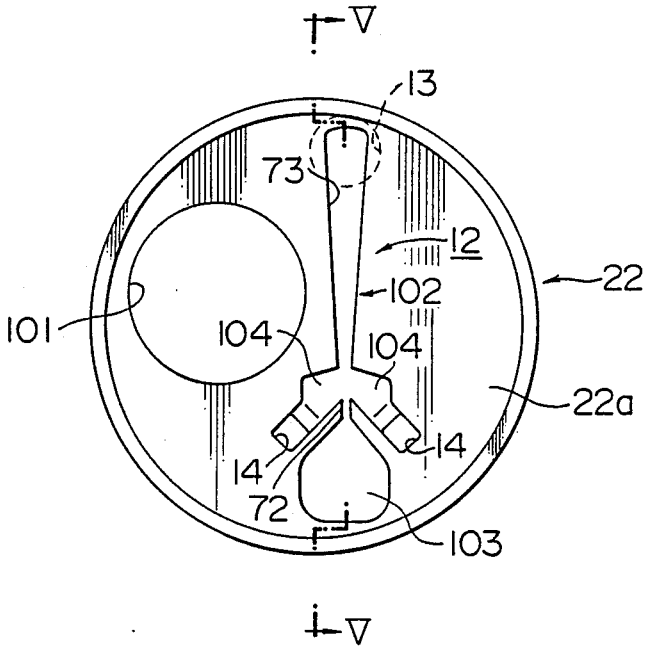
FIG. 4 is a plan view showing a cup-like member of a sub-tank employed in the fuel supply device illustrated in FIG. 1.

As shown in FIG. 2, a jet pump 12 has an upstream end connected to the fuel return pipe 11 through a vertically extending intermediate pipe section 114 which is formed, in an integral manner, on an inner surface of the peripheral wall of the sub-tank 5. The jet pump 12 is associated with the bottom wall 5*a* of the sub-tank 5, and has a fuel discharge port 13 and a pair of fuel suction ports 14 and 14, as shown in FIG. 4. The jet pump 12 is so designed that fluid energy of the fuel flowing through the fuel return pipe 11 toward the fuel discharge port 13 is utilized to deliver the fuel between the outer surface of the bottom wall 5*a* of the sub-tank 5 and the bottom surface la of the fuel tank 1, into the sub-tank 5 through the pair of fuel suction ports 14 and 14, subsequently to be described in detail. A vertically extending pipe section 105 is formed in integral relation to the inner surface of the peripheral wall of the sub-tank 5, and has a lower end connected to the fuel discharge port 13 of the jet pump 12. A first check valve 13*a* is arranged at an upper open end of the pipe section 105 for preventing the fuel within the sub-tank 5 from flowing from the fuel discharge port 13 of the jet pump 12 back toward the fuel suction ports 14 thereof through the pipe section 105. The check valve 13*a* is of well-known type having a pair of duck's bills formed of rubber.

The first check valve 13*a* at the upper end of the pipe section 105 connected to the fuel discharge port 13 of the jet pump 12 is so designed as to discharge the fuel in a direction substantially perpendicular to the longitudinal direction of the fuel pump 9, i.e., perpendicular to a direction from the ceiling surface 1*a* of the fuel tank 1 toward the bottom surface 1*b* thereof.

Referring back to FIG. 1, a second check valve 15 is arranged at the intake ports 6 of the sub-tank 5 for preventing the fuel within the sub-tank 5 from flowing from the same back into the fuel tank 1. The second check valve 15 is formed of rubber and has a shape like a conical cap.

The sub-tank 5 includes a plurality of metallic brackets 20 welded to the cover 3, a tubular member 21, and a cup-like member 22. The brackets 20 are spaced from each other circumferentially as apparent from FIG. 3. The tubular member 21 is formed of synthetic resinous material and is arranged inside of the brackets 20. The cup-like member 22 is formed of synthetic resinous material and is connected to a lower end of the tubular member 21 remote from the brackets 20 through a coupling member 100 formed of rubber which is high in elasticity.

Figure 3:
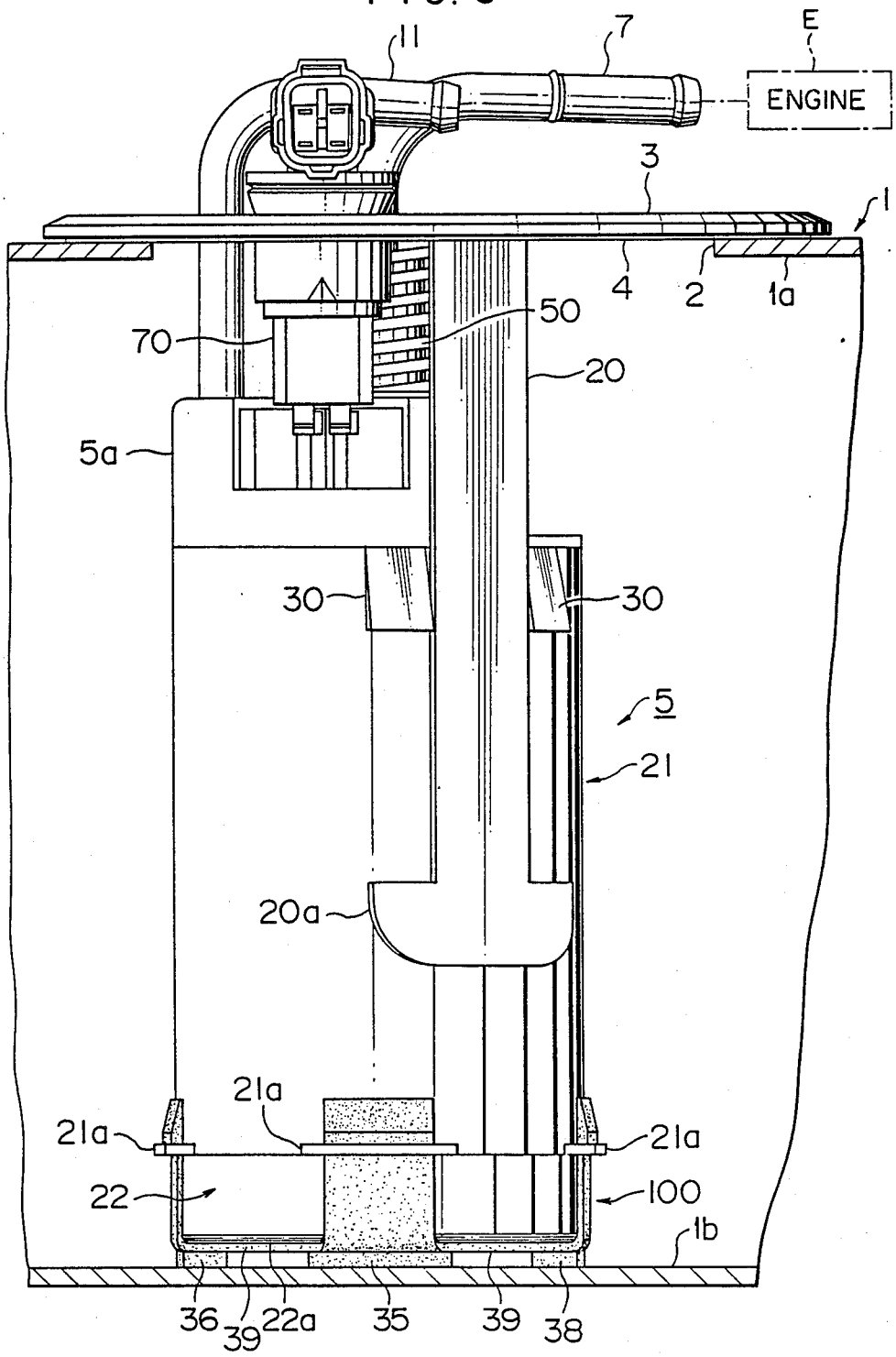
FIG. 3 is a fragmentary side elevational view as viewed from the arrow III in FIG. 1.

The tubular member 21 and the cup-like member 22 of the sub-tank 5 form a sub-tank body within which the fuel is stored. A plurality of pairs of engaging projections 30 are formed integrally at the end of the sub-tank body on the side of the brackets 20, i.e., in integral relation to an outer circumferential surface of an upper end portion of the tubular member 21. Each of the brackets 20 is located between a corresponding pair of adjacent engaging projections 30 as shown in FIG. 3 in such a manner that the sub-tank body can axially slide along the brackets 20. Each bracket 20 is formed at its forward or lower end with a hook section 20*a* which cooperates with the corresponding pair of engaging projections 30 to prevent the sub-tank body from coming out of the brackets 20, as will clearly be seen from FIG. 3. Thus, the sub-tank body formed by the tubular member 21 and the cup-like member 22 is adjustable in a vertical position thereof relative to the cover 3 as viewed in FIG. 3. In other words, the distance from the cover 3 to the bottom wall 5*a* of the cup-like member 22 is adjustable.

The aforementioned coupling member 100 has four cushion sections 35, 36, 37 and 38 which are arranged in circumferentially equidistantly spaced relation to each other about the axis of the sub-tank 5. The cushion section 35 through 38 are interposed between the outer bottom surface 22*a* of the cup-like member 22 and the bottom surface 1*b* of the fuel tank 1. Each pair of adjacent cushion sections are connected to each other through a web section 39 formed in integral relation to the coupling member 100.

The sub-tank 5 further includes a cap member 5*c* which is fitted in the upper open end of the tubular member 21. The cap member 5*c* is formed at its center in an integral manner, with an intermediate pipe 40 through which the fuel from the discharge port 10 of the fuel pump 9 is introduced into the fuel supply pipe 7. The cap member 5*c* is also formed therein, in an integral manner, with an intermediate pipe section 114*c* connected to the intermediate pipe section 114 in the peripheral wall of the tubular member 21. The intermediate pipe section 114*c* receives therein the fuel return pipe 11. A coil spring 50 is interposed between the cover 3 and the cap member 5*c* to bias the sub-tank body (the tubular member 21 and the cup-shaped member 22) away from the cover 3. Specifically, as shown in FIG. 2, a cylindrical retainer member 50*a* is fitted about a section 40*a* of the intermediate pipe 40 extending from the top wall of the cap member 5*c* toward the cover 3. The coil spring 50 is arranged about the retainer member 50*a* in coaxial relation thereto.

A cup-shaped cushion element 55 is arranged within the tubular member 21 at a location adjacent the lower end thereof. The lower end portion of the fuel pump 9 is fitted in a recess formed in the cushion element 55. A ring-like filter 56 is arranged within the cup-like member 22 in coaxial relation to the cup-like cushion element 55, and extends to surround the suction port 8 of the fuel pump 9. The cushion element 55 can absorb vibration of the fuel pump 9 in a direction perpendicular to the longitudinal axis of the fuel pump 9.

The details of the fuel supply device constructed as above will further be described.

The sub-tank body formed by the tubular member 21 and the cup-like member 22 has such an interior volume as to enable at least 450 cc of fuel to be stored within the sub-tank body. The coupling member 100 provided with the cushion sections 36 through 38 is formed of oil resistant rubber. The coupling member 100 engages the projections 21*a* at the lower end of the tubular member 21 of the sub-tank 5. It is required for the second check valve 15 in the form of a conical cap to have an opening pressure of at least 0.35 g/cm$^2$ and an opening area of at least 200 mm$^2$, in order for the second check valve 15 to be opened even if the remaining fuel within the fuel tank 1 is about 15 to 20 mm in height. The filter 56 has a cross-sectional shape like an annular bellows, but may be tubular in shape like a doughnut.

The fuel supply pipe 7 has a lower end portion thereof which is inserted into the intermediate pipe 40 through an O-ring seal 60 (FIG. 2). Adjustment of connection between the brackets 20 and the tubular member 21 enables the length of the entire sub-tank 5 from the cover 3 to vary. In accordance with the variation in the length, the fuel supply pipe 7 axially slides relatively within the intermediate pipe 40. At this time, the fuel supply pipe 7 axially slides in contact with the inner wall surface of the O-ring seal 60. Thus, it is possible to freely set the spatial distance from a fuel supply bore 7a formed at the lower end of the fuel supply pipe 7, to the discharge port 10 of the fuel pump 9.

Referring to FIG. 1, the fuel tank 1 is further provided with a fuel supply port 61 through which the fuel is supplied to the fuel tank 1. After the vehicle is completely assembled, a small amount of gasoline of the order of about 8 litters is introduced into the fuel tank 1. The second check valve 15 is opened under the pressure of the gasoline of the order of 8 litters, so that the fuel enters the sub-tank 5 through the intake ports 6 at the bottom 5a thereof. As the fuel within the sub-tank 5 is accumulated to a level of the suction port 8 of the fuel pump 9, the fuel pump 9 is placed in a condition capable of discharging the fuel through the discharge port 10. As the fuel pump 9 discharges the fuel, so that the level of the fuel within the sub-tank 5 is lowered, the second check valve 15 is opened to permit the fuel to enter the sub-tank 5 through the intake ports 6. Thus, at least an amount of fuel having a level corresponding substantially to that of the fuel within the fuel tank 1 is maintained within the sub-tank 5. That is, the second check valve 15 serves to maintain the fuel within the sub-tank 5, whose level corresponds, at the worst, substantially to the level of the fuel within the fuel tank 1.

A connector 70 formed of resinous material is mounted to the cover 3 and extends therethrough. Wiring on the outside of the fuel tank 1 is connected to the connector 70, to supply DC current of 12 volts to the fuel pump 9 through a cable 45. The fuel return pipe 11 is inserted into the intermediate pipe section 114 formed in the peripheral wall of the tubular member 21, and an O-ring seal 71 is arranged between the inner wall surface of the intermediate pipe section 114 and the fuel return pipe 11. An O-ring seal 74 is located at the lower end of the intermediate pipe 40. A ring-like spacer 75 is disposed below the O-ring seal 74 and around the discharge port 10 of the fuel pump 9.

Figure 5:
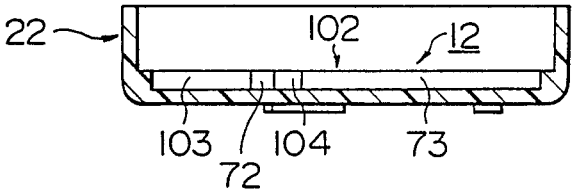
FIG. 5 is a cross-sectional view taken along the line V—V in FIG. 4.

As shown in FIG. 4, a circular bore or an opening 101 is formed through the bottom of the cup-like member 22. An inner surface of the bottom of the cup-like member 22 is formed with a groove 102 like a fluid control device serving as a jet pump 12, as also shown in FIG. 5. The groove 102 is formed by recesses provided in the inner bottom surface of the cup-like member 22. The groove 102 has a head section 103 which serves to receive the fuel supplied through the fuel return pipe 11 and the intermediate pipe section 114 shown in FIG. 2. A narrow nozzle section 72 is contiguous to the head section 103. The fuel jetted through the nozzle section 72 generates negative pressure at a pair of arm sections 104 and 104, to draw the fuel through the pair of fuel suction ports 14 and 14. The pair of fuel suction ports 14 and 14 extend through the bottom wall of the cup-like member 22 the same as the circular bore does. The groove 102 also has a diffuser section 73. The fuel discharge port 13 is connected to a downstream end of the diffuser section 73.

As shown in FIG. 1, a cover 106 is mounted on the inner surface of the bottom of the cup-like member 22, and cooperates with the inner surface to form the jet pump 12 like a fluid control device. The cover 106 partially covers the groove 102 of the jet pump 12 shown in FIG. 4. The cover 106 has a portion thereof which is fitted in the opening 101 formed in the bottom wall of the cup-like member 22. The portion of the cover 106 is formed therein with the pair of through bores serving as the intake ports 6. The intake ports 6 are normally closed by the second check valve 15.

The operation of the fuel supply device constructed as above will be described herein under.

A slight amount of fuel is supplied to the fuel tank 1 through the fuel supply port 61. As the fuel is maintained whose level 81 is of the order of about 15 to 20 mm in height from the bottom surface 1b of the fuel tank 1, pressure of the fuel opens the second check valve 15. Thus, the suction port 8 of the fuel pump 9 is filled with the fuel introduced through the filter 56 within the sub-tank 5. When voltage is applied to the fuel pump 9 in this state to render the fuel pump 9 operative, the fuel is drawn through the suction port 8, and is supplied to the engine E of the vehicle through the fuel supply pipe 7. Although not show, a pressure regulator is arranged on the side of the engine E of the vehicle in the well-known manner, for regulating the pressure of the fuel supplied to the vehicle engine E. Excess fuel is returned to the fuel tank 1 through the fuel return pipe 11 in the well-known manner. The fuel returned to the fuel tank 1 through the fuel return pipe 11 is supplied to the jet pump 12. The fuel is injected from the head section 103 of the jet pump 12 into the diffuser section 73 through the nozzle section 72. The injected fuel opens the first check valve 13a arranged at the upper end of the pipe section 105 connected to the fuel discharge port 13, and is discharged into the sub-tank 5. At this time, strong negative pressure is generated at the downstream end of the nozzle section 72 of the jet pump 12. By this negative pressure, the fuel is drawn into the groove 102 through the fuel suction ports 14. Accordingly, if the fuel pump 9 continues to be operated to supply the fuel toward the vehicle engine E, the fuel having its level 82 higher than the level 81 of the fuel within the fuel tank 1 is maintained within the sub-tank 5. The fuel accumulated within the sub-tank 5 flows to the suction port 8 of the fuel pump 9 through a bore 55a in the cushion element 55 and the filter 56, and is taken into the fuel pump 9 through the suction port 8. The fuel is again discharged through the discharge port 10. Thus, even if the level 81 of the fuel within the fuel tank 1 lowers and the fuel within the fuel tank 1 on the outside of the sub-tank 5 is fully consumed, the fuel pump 9 can continue to supply the fuel to the vehicle engine E, as far as the fuel exists within the sub-tank 5. The second check valve 15 prevents the fuel from flowing from the sub-tank 5 back to the exterior thereof through the intake ports 6 provided at the bottom wall 5a of the sub-tank 5. Further, the first check valve 13a prevents the fuel from flowing back from the fuel discharge port 13 of the jet pump 12 to the fuel suction ports 14 shown in FIG. 2 through the diffuser section 73 and the arm sections 104. That is, the first check valve 13a prevents the fuel from leaking from the interior of the sub-tank 5 to the exterior thereof. Thus, the fuel level 82 in the sub-tank 5 is normally maintained at a location higher than the level 81 of fuel within the fuel tank 1.

The first check valve 13a at the upper end of the pipe section 105 connected to the fuel discharge port 13 of the jet pump 12 is so directed as to discharge the fuel in a direction substantially perpendicular to the longitudinal axis of the fuel pump 9. Accordingly, even if fuel vapor is discharged through the first discharge port 13, it is enabled to restrain, as far as possible, that the vapor is drawn through the suction port 8 of the fuel pump 9.

Slidable connection between the brackets 20 and the tubular member 21 enables the length of the entire sub-tank 5 from the cover 3 to be adjusted. Accordingly, even if the fuel tank 1 is changed in size, it is possible to freely set the length of the entire sub-tank 5 accordingly. In this case, the distance between the fuel supply pipe 7 and the discharge port 10 of the fuel pump 9 can also be adjusted by sliding movement of the fuel supply pipe 7 within the intermediate pipe 40. In this connection, the change in the distance of the sub-tank 5 from the cover 3 causes the fuel return pipe 11 to slide relatively to the intermediate pipe section 114 at the O-ring seal 71.

In the manner described above, since the distance of the sub-tank 5 from the cover 3 is adjustable, the sub-tank 5 is always pressed against the bottom surface 1*b* of the fuel tank 1 under the biasing force of the coil spring 50, even if the pressure within the fuel tank 1 varies to change the height of the fuel tank 1. This makes it possible to draw the fuel to the last. Further, even if fuel tanks of different sizes are employed, the common sub-tank 5 can be used in these fuel tanks.

The sub-tank 5 is adjustable in whole length thereof, and the bottom wall 5*a* of the sub-tank 5 is located adjacent the bottom surface 1*b* of the fuel tank 1. In this connection, the cushion sections 35 through 38 are interposed between the bottom wall 5*a* of the sub-tank 5 and the bottom surface 1*b* of the fuel tank 1. Thus, there is no anxiety that contacting sounds are generated. Moreover, since the coil spring 50 is arranged between the cap member 5*c* and the cover 3 so that the sub-tank 5 is always pressed against the bottom surface 1*b* of the fuel tank 1. This prevents noises from being generated at the sub-tank 5 due to vibration of the vehicle. In the illustrated embodiment, the fuel pump 9 is a well-known regenerative pump of closed-impeller type rotatively driven by a DC motor. However, the fuel pump 9 should not be limited to this regenerative pump, but may be any other suitable pump.

In case where the fuel return pipe 11 is utilized to return the excess fuel more than the engine can spend, to the fuel tank 1, an amount of such excess fuel flowing through the fuel return pipe 11 varies depending upon the conditions of the vehicle engine E. Accordingly, the discharge performance of the fuel pump 9 and the performance of the jet pump 12 should be so determined that an amount of fuel more than the fuel consumption rate of the vehicle engine E is delivered into the sub-tank 5 by the jet pump 12, even when the fuel consumption rate of the engine is maximum, that is, even when the fuel returned to the fuel tank 1 through the fuel return pipe 11 is minimum in amount.

The cable 45 through which electric power is supplied to the fuel pump 9 shown in FIG. 1 is loosened between the connector 70 and the fuel pump 9, to cope with variation of the distance of the sub-tank 5 from the cover 3.

Vibration of the fuel pump 9 is absorbed by the cup-shaped cushion element 55. The fuel pump 9 is connected to the fuel supply pipe 7 through the intermediate pipe section 40 of the cap member 5*c* formed of synthetic resinous material. Thus, the vibration sounds generated at the fuel pump 9 are prevented from being transmitted to the fuel tank 1.

In the illustrated embodiment, the sub-tank 5 is mounted on the bottom surface lb of the fuel tank 1 in perpendicular relation thereto. However, the sub-tank 5 may be mounted on the bottom surface 1*b* in an inclined manner thereto.

Moreover, in the illustrated embodiment, the jet pump 12 is in the form of a flat plate, and is arranged at the lower end of the fuel pump 9. This makes it possible to reduce the head from the lower ends of the respective fuel suction ports 14 and 14 of the jet pump 12 to the nozzle section 72 thereof. Thus, the jet pump 12 can easily deliver the fuel from the exterior of the sub-tank 5 into the interior thereof, thereby it possible to reduce the size of the jet pump 12, or to enhance the performance of the jet pump 12. Moreover, since the jet pump 12 is formed by the groove 102 and the cover 106 covering the groove 102 similarly to a fluid control device, the number of component parts can also be reduced.

Figure 6:
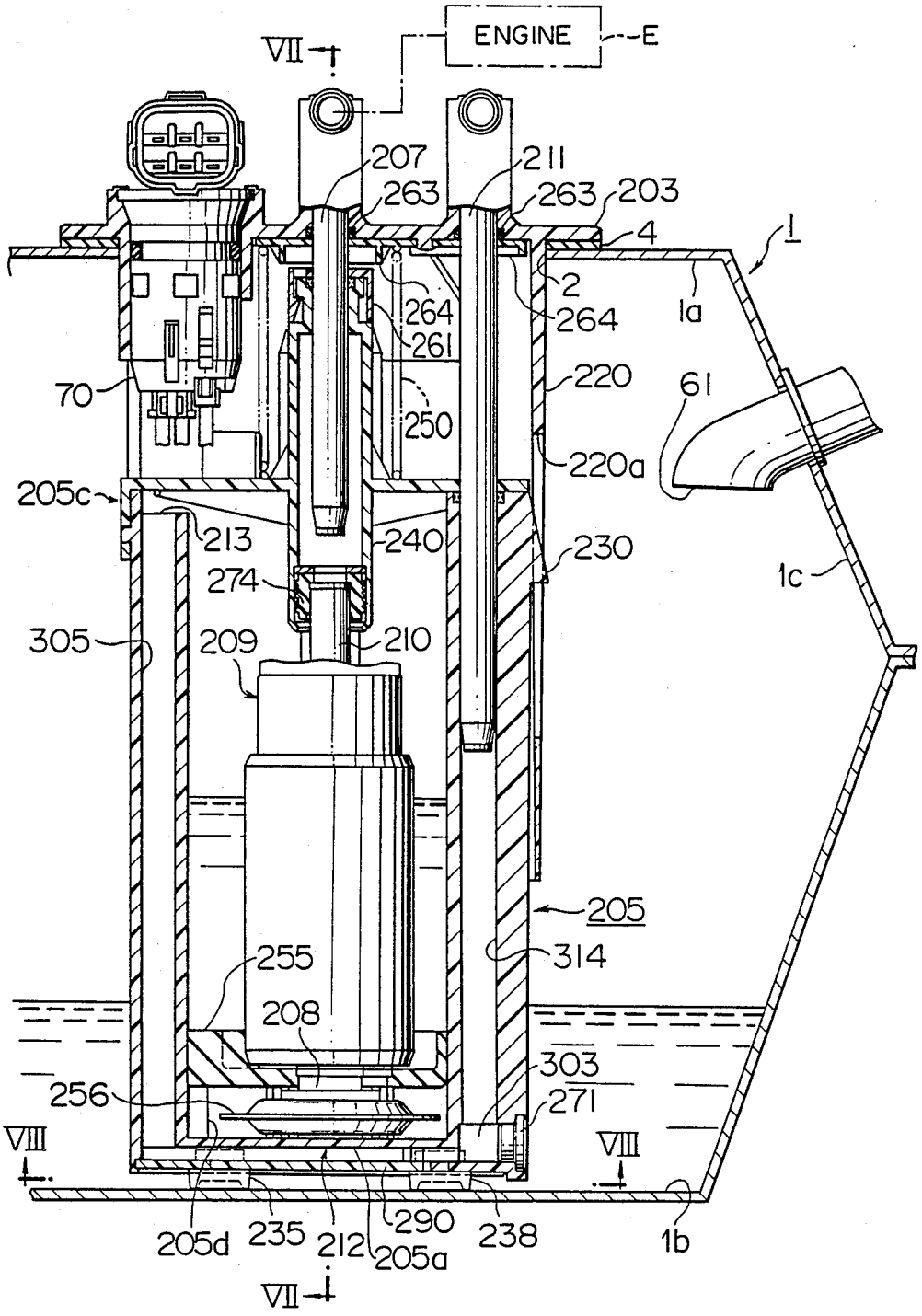
FIG. 6 is a partially cross-sectional front view showing a fuel supply device according to another embodiment of the invention.
Figure 7:
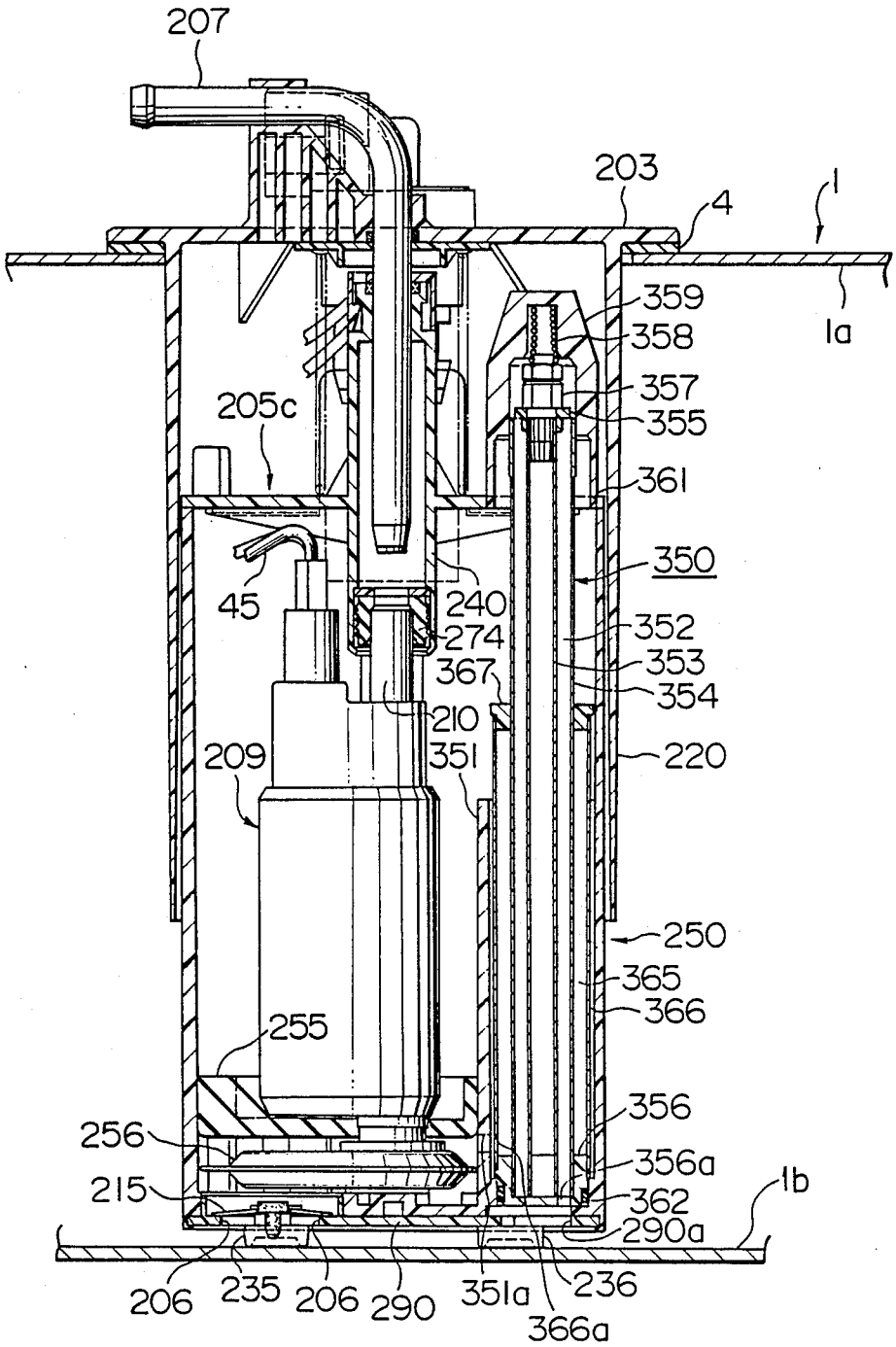
FIG. 7 is a cross-sectional view taken along the line VII—VII in FIG. 6.
Figure 8:
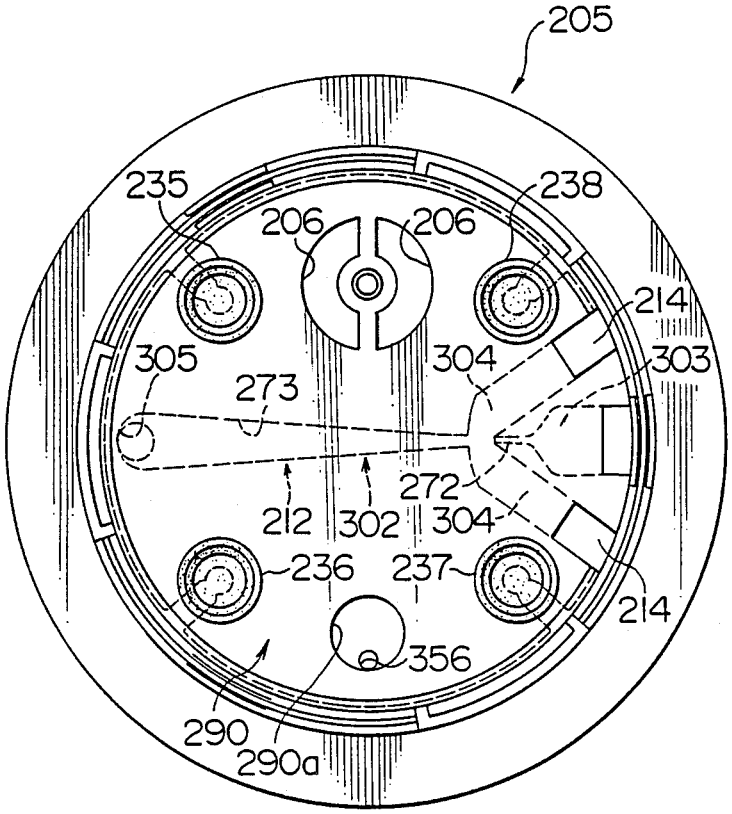
FIG. 8 is a bottom view as viewed from the arrow VIII—VIII in FIG. 6.

Referring to FIGS. 6 through 8, there is shown a fuel supply device according to a second embodiment of the invention. In these figures, components and parts like or similar to those illustrated in FIGS. 1 through 5 are designated by the same or like reference numerals, and the description of such like or similar components and parts will therefore to omitted to avoid repetition.

A cover 203 is formed of high density polyethylene, polyacetal or the like, and is provided with a plurality of brackets 220 in an integral manner. The brackets 220 extend downwardly from the cover 203 to fixedly support a sub-tank 205.

The sub-tank 205 is formed of high density polyethylene, polyacetal or the like, and is tubular in shape having an upper open end and a bottom wall 205*a*. The sub-tank 205 extends toward the bottom surface 1*c* of the fuel tank 1. The bottom wall 205*a* of the sub-tank 205 is abutted against the bottom surface 1*b* of the fuel tank 1 through cushion elements 235 through 238. Thus, the weight or load of the sub-tank 205 is primarily supported by the bottom surface lb of the fuel tank 1.

A plurality of circumferentially space latching pawls 230 are formed at an outer surface of an upper end portion of a peripheral wall of the sub-tank 20 and extend radially outwardly from the peripheral wall. The latching pawls 230 are fitted respectively into slits 220*a* formed in the respective brackets 220 in such a manner that the sub-tank 205 is prevented from moving horizontally, but is permitted to move vertically along the brackets 220.

As shown also in FIG. 8, a bottom plate 290 is fitted in the lower end of the sub-tank 205. The bottom plate 290 cooperates with the bottom wall 205*a* of the sub-tank 205 to form a double bottom structure. As shown in FIG. 7, a pair of fuel intake ports 206 and 206 are formed, which extend through the bottom plate 290. An opening is formed in the bottom wall 205*a* of the sub-tank 205. Thus, the fuel tank 1 communicates with the interior of the sub-tank 205 through the fuel intake ports 206 and the opening in the bottom wall 205*a*, so that the fuel within the fuel tank 1 can flow into the sub-tank 205.

A check valve 215 is arranged at the fuel intake ports 206, for preventing the fuel within the sub-tank 205 from flowing back into the fuel tank 1. The check valve 215 is mounted to the bottom plate 8, and has a shape like a conical cap or a mushroom-like shape The check valve 215 is formed of rubber-like material such as phlorosilicone or is formed in such a manner that fluorine or the like is backed onto resinous material such as PPS, NY or the like. Opening pressure of the check valve 215 is so set that it is opened to permit the fuel within the fuel tank 1 to be introduced into the sub-tank 205 when the level of the fuel within the fuel tank 1 is raised to a position slightly higher than that of the fuel within the sub-take 205, that is, when the pressure on the side of the fuel tank 1 is raised to a value slightly higher than that on the side of the sub-tank 205.

A fuel pump 209 is accommodated in the sub-tank 205. The fuel pump 209 has a pump case which is supported by a cushion element 255 which, in turn, is supported by support ribs **205*d* formed on the sub-tank 205. Thus, the fuel pump 209 is supported by the sub-tank 205 through the cushion element 255**.

The fuel pump 209 is provided at its lower end with a suction port 208 which extends to a location lower than the cushion element 255 and which is close to an inner surface of the bottom wall **205*a* of the sub-tank 205**.

A fuel filter 256 is connected to the suction port 208 of the fuel pump 209. The fuel filter 256 may be a mesh filter, but preferably is one capable of being impregnated with fuel due to capillary phenomena. For example, the fuel filter 256 is a twilled filter in which if only a part of the filter is immersed in the fuel, the filter is wetted by the fuel due to the surface tension thereof, and a part of the filter, which is exposed to air, is sealed by the fuel-wetted part of the filter. A gap of the order of 1 mm is secured between the lower surface of the fuel filter 256 and the inner surface of the bottom wall **205*a* of the sub-tank 205**.

A discharge port 210 is provided at the upper end of the fuel pump 209. A fuel supply pipe 207 is communicated at one end thereof with the discharge port 210. The fuel supply pipe 207 extends at the other end thereof to the engine E. The discharge port 210 is connected to the fuel supply pipe 207 through a connecting tubular section 240 formed in integral relation to a support **205*c* which is fitted about the upper open end of the sub-tank 205**.

Specifically, the support **205*c* has a function of a closure covering the upper open end of the sub-tank 205. The support 205*c* is formed of high density polyethylene, polyacetal or the like. The connecting tubular section 240 is integrally formed at the center of the support 205*c*. The discharge port 210 of the fuel pump 209 is fitted in a lower open end of the connecting tubular section 240, and is maintained liquid-tight by a packing seal 274**.

The lower end portion of the fuel supply pipe 207 is inserted into an upper open end of the connecting tubular section 240, and is maintained liquid-tight by a cap 261 and an X-ring 260 with respect to the upper open end of the connecting tubular section 240. Thus, the discharge port 210 and the fuel supply pipe 207 communicate with each other through the connecting tubular section 240 formed on the support **205*c***.

The fuel supply pipe 207 is connected to the engine E through a pressure regulator, like the first embodiment described previously. Fuel branching from the pressure regulator is returned to the fuel tank through a fuel return pipe 211. The fuel supply pipe 207 and the fuel return pipe 211 are mounted to the cover 203 in a liquid-tight manner by respective O-rings 263 and 263 which are retained respectively by retaining plates 264 and 264 formed of resinous material. The retaining plates 264 and 264 are fixed to the cover 203 by heat-staking the latter.

A spring 250 is disposed to enclose the connecting tubular section 240 and is disposed between the support **205*c* covering the upper open end of the sub-tank 205 and the retaining plate 264 through which the fuel supply pipe 207 extends. The spring 250 biases the sub-tank 205 downwardly with force of the order of, for example, 2 to 7 Kg, to prevent floating and vibration of the sub-tank 205**.

Like the first embodiment described previously, the fuel return pipe 211 extends through the cover 203 and is fitted into an intermediate pipe section 314 which is formed integrally on the inner surface of the peripheral wall of the sub-tank 205. The intermediate pipe section 314 has a lower end which is connected to a fuel introducing heat section 303 of a jet pump 212 formed at the bottom of the sub-tank 205. The end of the fuel introducing heat section 303 is closed by a blind plug 271 as shown in FIG. 6.

As clear shown in FIG. 8, the jet pump 212 is constituted by a groove 302 in the form of a flat fluid control device. The groove 302 of fluid control device type is formed in an outer surface of the bottom wall **205*a* of the sub-tank 205. The outer surface of the bottom wall 205*a* is covered by the bottom plate 290 to form the jet pump 212**.

The groove 302 of fluid control device type has a diffuser section 273 whose downstream end communicates with a vertically extending fuel discharge passage 305. The fuel discharge passage 305 is formed integrally in the inner surface of the peripheral wall of the sub-tank 205. The fuel discharge passage 305 has an upper end which serves as a fuel discharge port 213. The fuel discharge port 213 is positioned at an upper location within the sub-tank 205, and is directed upwardly. The fuel discharge port 213 is spaced, for example, about 5 mm apart away from the inner surface of the support **205*c* which covers the upper open end of the sub-tank 205**.

As shown in FIG. 7, a fuel sender 350 of electrostatic capacity type is provided for detecting the level of the fuel within the sub-tank 205, to output a signal representative of the level of the fuel.

Specifically, the fuel sender 350 is forcibly fitted in a sender guide 351 formed integrally on the sub-tank 205, in such a manner as to be protected by the sender guide 351. A fuel-level detecting section 352 of the sender 350 is constituted by an annular space defined between a first pipe 353 and a second pipe 354. The first and second pipes 353 and 354 are maintained in concentrically spaced relation to each other by an upper or first spacer 355 and a lower or second spacer 356. A nut 357 fixes the first spacer 355 in position. A spring 358 is disposed on the nut 357. A cap 359 is fitted in an opening 361 of the support **205*c*, to cause the spring 358 to bias the nut 357, thereby fixing the first spacer 355 in position. An O-ring seal 362 is disposed between the second spacer 356 and the sender guide 351, to prevent the fuel filled in the sub-tank 205** from leaking.

The fuel is introduced into the detecting section 352 through an opening **290*a* in the bottom plate 290 of the sub-tank 205 and an opening 356*a* in the second spacer 356. The opening 356*a* in the second spacer 356 is about 3 mm in diameter to provide a response delay to a certain degree. A correcting section 365 of the sender 350 is defined between a third pipe 366 and the second pipe 354, for correcting variation in condenser capacity depending upon various kinds of fuel. The fuel within the sub-tank 205 is introduced into the correcting section 365 through a correcting fuel inflow port 351*a* formed in the sender guide 351 and through an opening 366*a*** formed in the third pipe 366. A third spacer 367 is disposed between an upper end of the third pipe 366 and the second pipe 354, and the second spacer 356 is disposed between a lower end of the third pipe 366 and the second pipe 354. By these spacers 367 and 356, the distance between the second and the third pipes 354 and 366 is maintained constant. The sub-tank 205 is always filled with the fuel under the normal or usual running conditions under which the engine fuel consumption amount is equal to or less than 60 to 80 litters. Accordingly, if the correcting section 365 is maintained in communication with the interior of the sub-tank 205, the correcting section 365 is always filled with the fuel. This is advantageous in that correction can sufficiently be carried out without being subject to the influence of a change in an amount of fuel within the sub-tank 205 and a change in the running conditions of the engine E.

The bottom plate 290 is fixedly mounted to the lower end of the sub-tank 205 by forcible-fitting and heat-staking. The outer periphery of the bottom plate 290 is circular in shape so that the outer periphery can be forcibly fitted in the lower end of the sub-tank 205 in a sealed manner, in order to prevent leakage at the connection between the downstream end of the diffuser section 273 of the jet pump 212 and the lower end of the fuel discharge passage 305. The intake port 214 and the opening 290*a* are formed in the bottom plate 290 in an integral manner.

The operation of the fuel supply device constructed as above according to the second embodiment will be described below.

The fuel tank 1 installed on the vehicle is supplied with fuel through the fuel supply port 61. When the level of fuel within the fuel tank 1 reaches a value of the order of 15 to 20 mm in height from the bottom surface 1*b* of the fuel tank 1, pressure of the fuel opens the check valve 215 to permit the fuel within the fuel tank 1 to flow into the sub-tank 205 through the fuel intake ports 206. The fuel of the level at least equal to that of fuel within the fuel tank 1 is contained in the sub-tank 205. Accordingly, the fuel filter 256 connected to the suction port 208 of the fuel pump 209 is immersed in the fuel.

When the fuel pump 209 is operated in this state, the fuel in the vicinity of the bottom wall 205*a* of the sub-tank 205 is drawn into the fuel pump 209 through the suction port 208 while being filtered by the fuel filter 256. The drawn fuel is pressurized and is pumped out through the discharge port 210. The discharged fuel is supplied to the engine E of the vehicle through the connecting tubular section 240 and the fuel supply pipe 207.

Like the first embodiment described previously, a well-known pressure regulator is arranged on the side of the vehicle engine E. Excess fuel resulting from the regulation by the pressure regulator is returned to the fuel tank 1 through the fuel return pipe 211. The fuel returned to the fuel tank 1 through the fuel return pipe 211 is supplied to the jet pump 212 through the intermediate pipe section 314 of the sub-tank 205.

At the jet pump 212, the fuel introduced through the intermediate pipe section 314 is supplied to the fuel introducing head section 303. The fuel flows through the narrow nozzle section 272 and is injected toward the diffuser section 273. At this time, strong negative pressure is generated at the downstream end of the nozzle section 272. The negative pressure causes the fuel within the fuel tank 1 to be drawn into the sub-tank 205 through the fuel suction ports 214 and 214 and the pair of arm sections 304 and 304 formed in the bottom plate 290. The fuel forcibly drawn in this manner flows through the fuel discharge passage 305 communicating with the downstream end of the diffuser section 273, and is discharged into the sub-tank 205 through the fuel discharge port 213 at the upper end of the fuel discharge passage 305.

After stoppage in operation of the fuel pump 209, the fuel within the sub-tank 205 tends to flow back to the fuel tank 1 through the fuel discharge port 213 and through the suction ports 214 and 214. Since, however, the fuel discharge port 213 opens to the sub-tank 205 at a location adjacent the upper end thereof, the fuel above the fuel discharge port 213 escapes, but the fuel below the fuel discharge port 213 does not escape. That is, the fuel within the sub-tank 205 is prevented from escaping through the fuel discharge port 213, whereby making it possible to maintain the level of the fuel up to the level of the fuel discharge port 213 to the maximum.

Accordingly, even if the fuel pump 209 is stopped in operation, the fuel of the level higher than the level of the fuel within the fuel tank 1 can be stored within the sub-tank 205.

Thus, eve if the engine E is started in operation in such a state that the remaining fuel within the fuel tank 1 is small in amount, or even if the level of the fuel within the fuel tank 1 is inclined due to parking of the vehicle on a slope or on an inclined ground, the fuel pump 209 can draw the fuel remaining in the sub-tank 205, whereby making it possible to start the engine E.

In the second embodiment, the fuel discharge port 213 of the jet pump 212 opens to the upper location within the sub-tank 205. Accordingly, the fuel within the sub-tank 205 is prevented from escaping to the fuel tank 1 through the fuel discharge port 213, whereby making it possible to eliminate the necessity that a specific check valve is disposed at the fuel discharge port 213. By this reason, it is possible to reduce the number of component parts. Further, it is possible to avoid troubles such as maintenance and the like due to arrangement of the check valve at the fuel discharge port 213. Furthermore, no pressure loss occurs due to the arrangement of the check valve, whereby making it possible to enhance the performance of the jet pump 212.

Moreover, in the second embodiment, the groove 302 of flat fluid control device type is formed in the bottom wall 205*a* of the sub-tank 205. The position at the bottom of the sub-tank 205 is easy in processing and is a dead space. Accordingly, it is possible to obtain a larger volume in the sub-tank 205, as compared with a case where a groove of fluid control device type is formed within the sub-tank.

Because of the construction in which the groove 302 of fluid control device type is formed in the bottom wall 205*a* of the sub-tank 205 and is covered by the bottom plate 290, the component parts can be reduced in number. Further, if the sub-tank 205 is formed of synthetic resinous material, the groove 302 of fluid control device type can be formed in an integral manner, so that no long time is required for the processing. In this connection, the groove 302 of fluid control device type may be formed in the bottom plate 290.

What is claimed is:

1. A fuel supply device for vehicles, comprising:

a fuel tank installed on a vehicle, said fuel tank having a ceiling surface, a bottom surface and a side surface, said ceiling surface being formed therein with an opening;

a cover closing said opening in said fuel tank;

a sub-tank having a bottom wall and being fixedly mounted to said cover, said sub-tank being arranged within said fuel tank so as to extend toward said bottom surface of said fuel tank, and being capable of storing therein fuel of a level higher than that of fuel within said fuel tank;

intake port means provided in said bottom wall of said sub-tank, through which intake port means the fuel within said fuel tank is adapted to be taken into said sub-tank;

a fuel supply pipe extending through said cover and fixedly mounted to the same, said fuel supply pipe being arranged to extend between an interior of said fuel tank and an engine of the vehicle on the outside of said fuel tank;

a fuel pump disposed within said sub-tank, said fuel pump being provided with a suction port directed toward said bottom wall of said sub-tank and with a discharge port directed toward said ceiling surface, said discharge port being connected to said fuel supply pipe;

a fuel return pipe through which a part of the fuel discharged through said discharge port of said fuel pump is directed into said sub-tank toward said bottom wall of the same;

a jet pump connected to said fuel return pipe and having fuel discharge port means and fuel suction port means, said jet pump delivering the fuel within said fuel tank into said sub-tank from an exterior thereof through said fuel suction port means by using fluid energy of the fuel flowing through said fuel return pipe and through said fuel discharge port means;

a pipe element connected to said fuel discharge port means of said jet pump, said pipe element extending upward within said sub-tank and having an upper end opening, through which opening the fuel is supplied into said sub-tank; and a check valve arranged at said intake port means to prevent the fuel within said sub-tank from flowing out of the same into said fuel tank, wherein said jet pump is constituted by a groove forming a flat fluid control device arranged between said fuel pump and said bottom wall of said sub-tank, said groove being provided therein with said fuel suction port means and said fuel discharge port means of said jet pump.

2. A fuel supply device according to claim 1, wherein said upper end of said pipe element is so directed as to discharge the fuel in a direction substantially perpendicular to a longitudinal direction of said fuel pump.

3. A fuel supply device according to claim 1, wherein said sub-tank includes at least one metallic bracket fixedly mounted to said cover and a sub-tank body formed of synthetic resinous material and connected to said bracket, said sub-tank body having an end on the side of said bracket, and said end of said sub-tank body being provided with at least one pair of engaging projections in an integral manner, wherein said bracket is inserted between said projections to connect said bracket to said sub-tank body, so that said sub-tank body is slidable longitudinally thereof, and wherein engagement between a hook section provided at a forward end of said bracket and said projections on said sub-tank body prevents separation of said bracket and said sub-tank body from each other after having been assembled them together.

4. A fuel supply device according to claim 1, wherein said device further include a cushion element mounted to said sub-tank, and said cushion element is disposed between said bottom wall of said sub-tank and said bottom surface of said fuel tank.

5. A fuel supply device according to claim 3, wherein said device further includes a coil spring arranged between an upper end of said sub-tank and said cover to elastic bias said sub-tank away from said cover.

6. A fuel supply device according to claim 1, wherein said device further includes a cup-like cushion element arranged to surround a lower end of said fuel pump on the side of said suction port thereof, and a ring-like filter arranged in coaxial relation to said suction port of fuel pump, said filter being interposed between said cup-like cushion element and said bottom surface of said fuel tank so that said filter absorbs vibration of said fuel pump in a direction perpendicular to the longitudinal direction of said fuel pump.

7. A fuel supply device according to claim 1, wherein said device further includes a check valve disposed at said upper end of said pipe element for preventing the fuel from flowing from said sub-tank back to said fuel tank through said pipe element.

8. A fuel supply device for vehicles, comprising:

fuel tank installed on a vehicle;

a sub-tank accommodated in said fuel tank and having a bottom wall, said sub-tank being capable of storing fuel of a level higher than that of fuel within said fuel tank;

fuel intake port means provided in said bottom wall of said sub-tank for introducing fuel within said fuel tank into said sub-tank;

a check valve disposed in said fuel intake port means for preventing the fuel within said sub-tank from flowing out into said fuel tank;

a fuel pump arranged within said sub-tank and having a suction port which opens to a location in the vicinity of said bottom wall of said sub-tank, and a discharge port connected to a fuel supply pipe;

a fuel return pipe through which a part of the fuel discharged through said discharge port of said fuel pump is returned into said sub-tank; and a jet pump connected to said fuel return pipe, said jet pump having fuel discharge port means opening to an interior of said sub-tank and fuel suction port means opening to said fuel tank, said jet pump drawing the fuel within said fuel tank through said fuel suction port means by using fluid energy of the fuel flowing through said fuel return pipe and said fuel discharge port means, wherein said fuel discharge port means of said jet pump opens to a location adjacent an upper end of said sub-tank, and wherein said jet pump is constituted by a flat fluid control device and is disposed at a bottom of said sub-tank.

9. A fuel supply device according to claim 8, wherein said fuel tank has a ceiling surface, a bottom surface and a side surface, said ceiling surface being formed therein with an opening, wherein said device further includes a cover closing said opening in said fuel tank said cover comprising at least one bracket fixedly mounted thereto, wherein said fuel supply pipe and said fuel return pipe extend through said cover and are fixedly mounted thereto, said sub-tank being connected to said bracket for sliding movement relative thereto, wherein said cover, said bracket and said sub-tank are formed of resinous material, and wherein said cover and said bracket are integral with each other.

10. A fuel supply device according to claim 8, wherein said device further includes a sender of electrostatic capacity type arranged within said sub-tank for detecting the level of the fuel within said sub-tank.

* * * * *